219-121 SR
10/24/78 XR 4,122,292

United States Patent [19]
Karinsky

[11] 4,122,292
[45] Oct. 24, 1978

[54] ELECTRIC ARC HEATING VACUUM APPARATUS

[76] Inventor: Viktor Nikolaevich Karinsky, bulvar Novoselovoi, 10, kv. 43, Odintsovo Moskovskoi oblasti, U.S.S.R.

[21] Appl. No.: 722,655

[22] Filed: Sep. 13, 1976

[51] Int. Cl.[2] ..... H05H 1/26
[52] U.S. Cl. ..... 13/2 P; 219/121 R
[58] Field of Search ..... 13/31, 2 P, 1, 9; 219/121 R, 121 P; 313/306, 307, 343

[56] References Cited

U.S. PATENT DOCUMENTS

| | | | |
|---|---|---|---|
| 3,409,529 | 11/1968 | Chopra et al. | 13/1 X |
| 3,634,045 | 1/1972 | Dugdale et al. | 13/31 X |
| 3,980,802 | 9/1976 | Paton et al. | 13/18 |

*Primary Examiner*—R. N. Envall, Jr.
*Attorney, Agent, or Firm*—Lackenbach, Lilling & Siegel

[57] ABSTRACT

An electric arc heating vacuum apparatus for treating a workpiece of an electrically conducting material comprises an evacuated chamber, an electrically conducting support means on which the workpiece is mounted within said chamber, and a hollow hot cathode composed of a preset number of rods of a thermionic alloy. The rods, forming the hollow hot cathode, are affixed to an electrically conducting cathode support, which is connected to the negative terminal of a D.C. power source, the positive terminal of the same source being connected to the electrically conducting support means on which is mounted the workpiece being treated. This arrangement, provided the inert gas is fed into the cathode inner space between the hollow hot cathode and the workpiece being treated, causes an electric arc to initiate. Once started, the electric arc is sustained to provide heating of the workpiece being treated.

The invention drastically cuts down the costs involved in manufacturing a hollow hot cathode. It also makes it possible to enhance both the current intensity and the power of the electric arc in obtaining heating zones of various shapes on the surface of the workpiece being treated.

23 Claims, 16 Drawing Figures

ELECTRIC ARC HEATING VACUUM APPARATUS

The present invention relates to electric heating devices using direct electric arc heating, and more particularly to an electric heating vacuum apparatus. These devices may be used as heating sources in metallurgical processes for melting, refining, degasing, heat treating, welding and reducing metals and alloys, and also in other processes of high temperature treatment of electrically conducting materials in a vacuum. The operation principle of these devices is based on the use of an electric arc in a vacuum between the hollow hot cathode, made of a thermionic material, and the workpiece being treated, made of an electrically conducting material.

Essentially, the direct electric arc heating resides in striking and sustaining a powerful electric arc between two electrodes one electrode being the workpiece which is heated or treated and which is made of an electrically conducting material, and the second electrode being a non-consumable or non-melting electrode. Generally, electric arcs are characterized by heavy currents (several hundreds or thousands of amperes) and low voltage (several dozen volts). Non-consumable electrodes are sub-divided into two groups "hot", the electric arc is initiated and sustained through thermionic emission obtained from a highly heated electrode, and "cold", the electric arc occurs in the vapors of the material being heated.

As a rule hot electrodes are connected to the negative terminal of a D.C. power source, i.e. used as cathodes, and "cold" electrodes are connected to an A.C. source or to the positive terminal of a D.C. power source, i.e. used as anodes.

Cold non-consumable electrodes are usually made of copper and are intensively water-cooled. To avoid destruction of the electrode at the point of its contact with the electric arc, it is necessary to provide rapid displacement of the electric arc with respect to the electrode surface. This is attained by electrode rotation in the form of a wheel or cone-shaped, or by rotation of an electric arc electrode side surface by a magnetic field.

All cold electrodes require complex cooling systems, a power supply and displacement thereof with respect to the workpiece being heated. Besides, cold electrodes provide only for short-length electric arcs (several centimeters), which limits the scope of their application, for example, when the melt stock is fed to the electric arc heating zone.

Hot non-consumable electrodes in the form of a single rod of a refractory thermionic material, for example, graphite or tungsten, do not make it possible to obtain in a vacuum stable and spacially firmly established electric arc of great length (dozens of centimeters). In working with electric arcs of several centimeters in length these electrodes are covered with vapours and sprays off the material being treated. This causes severe erosion and transfer of the electrode material onto the work being treated.

In 1956 a new type of electric arc was discovered (see U.S. Pat. Nos. 2,920,234; 2,927,232; and 2,956,195). It was produced in a vacuum by a hot thermionic cathode in the form of a tube with an open end thereof facing the work being treated, the anode. This apparatus comprises an evacuated chamber with a tube therein being fixed in the cooled support used for feeding inert gas therethrough into the tubular space, which establishes the pressure difference between the evacuated chamber and the tubular inner space, used as a hollow hot cathode. The gas within the tube, the cathode inner space, is ionized by electrons emitted from the inner surface of the hollow hot cathode. Later, the inert gas (plasma) itself becomes a powerful emitter, that is, the electron source sustains the electric arc between the tubular (hollow) hot cathode and the work being heated, the anode. In addition, the electric arc is stabilized by a longitudinal magnetic field coaxial with the electric arc column.

The electric arc thus obtained features a high stability of electric values and is firmly established spacialy notwithstanding a considerable space between the hollow hot cathode and the anode (dozens of centimeters). Specific features of the arc are its high energetic efficiency (over 50%) and the long service life of the hollow hot cathode, which is possible due to the absence of the concentrated cathode spot which tends to destroy the cathode material. This type of electric arc is known as "the hollow hot cathode discharge", or else as the "plasma-electron beam". Hence, the electric arc heating vacuum devices using this type of discharge are known as "hot hollow cathode devices" or else as "plasma-electron guns".

There is also known one more electric arc heating vacuum apparatus using the hot hollow cathode. This apparatus comprises an evacuated chamber connected with a vacuum pump used to maintain a pressure within the evacuated chamber on the order of $10^{-2}$ mm Hg to $10^{-3}$ mm Hg. Mounted within the evacuated chamber is the electrically conducting stand for supporting the workpiece being treated, in the form of a water-cooled mold and accommodating the workpiece being treated, powdered metal being melted to form a molded article therefrom such as a solid metal ingot. Mounted within the evacuated chamber, coaxially aligned with the workpiece supporting stand and placed at a preset distance thereof is a metal tube made from a thermionic alloy (tantalum or tungsten) which serves as the hollow hot cathode. The hollow hot cathode is fixed at one end to the water-cooled cathode support of an electrically conducting material, its other end, being the cathode inner space, faces the workpiece being treated. To initiate and sustain the electric arc between the hollow hot cathode and the workpiece being treated, a D.C. power source is used which has its positive terminal connected to the workpiece supporting stand and its negative terminal connected to the cathode support.

The apparatus is provided with a solenoid which establishes a constant magnetic field coaxial with the electric arc column. The magnetic field is used to prevent spurious electric discharges prone to occur between the cathode support and the apparatus elements being under the anode potential. In addition, it serves to constrict and focus the electric arc column.

Means for delivering a flow of gas into the hollow tubular cathode is represented in the form of a tubular conduit within the cathode support. The inert gas, being fed therethrough, ensures the pressure difference between the tubular cathode and the evacuated chamber. The inert gas being fed into the tubular cathode is preionized by a high frequency discharge. A D.C. power source is then energized to sustain the electric arc between the hollow hot cathode and the workpiece being treated, the workpiece being an ingot formed in the course of melting a material delivered to the electrically conducting support means made in the form of a mold.

One of the basic parameters determining the efficiency of the process of treatment by means of the hollow hot cathode apparatus in a tolerable current intensity of the electric arc, and hence the power of the electric arc heating vacuum apparatus. The tolerable current value is limited by the size of the hollow hot cathodes made of a thermionic alloy. For example, one of the known heating devices makes use of hollow hot cathodes of 1.6 to 16.0 mm in diameter, and about 75 mm in length. This makes it possible to establish an electric arc at 50 volts and several hundreds of amperes. The electric arc with a maximum power of 400 kwt and a current intensity of 5000 amperes has been obtained on a hollow hot cathode 40 mm in diameter and about 300 mm in length.

To enhance the current intensity of the electric arc, it is necessary to increase the hollow hot cathode in length and diameter, and the length of the tube and the thickness of its walls. However, the production cost of tubes is extremely high, which renders the application of the electric arc vacuum devices with the hollow hot cathode impractical. This is especially the case when powerful electric arcs are to be applied.

In operating the apparatus with the hollow hot cathode, there arises the neccessity of using a magnetic field coaxial with the electric arc. In the absence of a magnetic field, there takes place ionization of the tenuous atmosphere within the evacuated chamber, which results in spurious arc discharges off the electrically conducting cathode support onto the walls of the evacuated chamber which is usually electrically connected to the workpiece being treated. The magnetic field is developed by a solenoid being wound onto the evacuated chamber or arranged therein. The mounting of the solenoid limits the space of the evacuated chamber, causes inconviniences during the operation cycle, and impairs the watching procedure of the treating process of the material.

The shape of the hollow hot cathode, made of a piece of tube, presupposes a circular form of the heating zone on the surface of the workpiece being treated. When there is a necessity of obtaining a heating zone of an elongated oval form, the simultaneous use of several hollow hot cathodes is practiced. This, however, results in a lack of operating space and causes undesirable construction of the electric arcs of the adjacent hollow hot cathodes.

It is an object of the present invention to provide an electric arc heating vacuum apparatus, which would ensure high tolerable current values of an electric arc between the hollow hot cathode and the workpiece being treated.

A further object of the invention is to provide an electric arc heating vacuum apparatus for obtaining a heating zone on the surface of the workpiece being treated, having not only a circular form but an oval one as well.

Another object of the present invention is to provide an electric arc heating vacuum apparatus which will make it possible to adjust the power concentration in the electric arc heating zone.

Still another object of the invention is to provide an electric arc heating vacuum apparatus of a construction to ensure suppression of spurious electric discharges occurring between the hollow hot cathode and walls of the evacuated chamber.

Yet another object of the invention is to provide an electric arc heating vacuum apparatus, wherein the hollow hot cathode is made of inexpensive materials.

These and other objects are attained in an apparatus comprising an evacuated chamber; an electrically conducting support means on which a workpiece being treated within the chamber; a hollow hot cathode made of a thermionic alloy spaced from the workpiece being treated and having a cathode inner space facing the workpiece being treated; and a cathode support of an electrically conducting material joined with the hollow hot cathode; means for delivering a flow of gas into the tubular cathode; and a D.C. power source connected to the electrically conducting support means of the workpiece being treated intended for obtaining an electric arc between the hollow hot cathode and the workpiece being treated. According to the invention, the hollow hot cathode is formed of rods, the depth of the cathode inner space being at least 1.5 times greater than the smallest size of its cross-section.

It is preferable that the rods of the hollow hot cathode each have one end fixed directly to the cathode support, the other end of each rod facing the workpiece being treated.

It is expedient that the ends of the rods, fixed to the cathode support, be arranged circularly.

It is feasible that the ends of the rods being fixed to the cathode support be arranged along segments of two parallel lines spaced from each other.

It is possible that the rods of the hollow hot cathode have the side surface thereof rigidly affixed to the support stands being secured to the cathode support and be arranged at least within two planes.

It is quite expedient that there be a clearance at least between one pair of adjacent rods.

It is also convenient that the clearance between the ends of adjacent rods facing the workpiece being treated be made less than that between the ends of the same rods being fixed within the cathode support.

It is preferable that the hollow hot cathode be arranged in a jacket of a heat resistant material in direct proximity to the hollow hot cathode. Provided in the jacket wall facing the workpiece being treated is an inlet for the electric arc to pass therethrough on its way from the hollow hot cathode to the workpiece being treated.

It is very convenient to have the jacket secured to the cathode support.

It is quite possible to provide for the cathode support to be arranged within the electrically conducting pipe being electrically isolated both from the cathode support and from the electrically conducting support means of the workpiece being treated.

It is highly expedient that the jacket be fixed onto the electrically conducting pipe.

It is advantageous that the electrically conducting pipe and jacket be made integral of a heat resistant electrically conducting material.

It is convenient that serving as a means for delivering a flow of gas into the cathode be at least one inlet made in the jacket walls.

It is still more con the means for delivering a flow of gas into the cathode inner space comprise at least one conduit between the electrically conducting pipe and the cathode support.

The herein disclosed invention makes it possible to enhance the efficiency of the process of treatment of the workpiece by increasing the electric arc power, the arc being made between the hollow hot cathode, formed of the rods, and the workpiece being treated.

The expense involved in manufacturing the apparatus is reduced by making use of parts and units of inexpensive materials. To compare the herein described apparatus of an equal capacity with the known apparatus utilizing the hollow hot cathode, the expence involved in manufacturing the former is several times less. By increasing the number of the apparatus simple and uniform elements, the rods, which form the hollow hot cathode, it is possible to substantially enhance the heater's capacity. For example, the apparatus in accordance with the present invention was tested at an amperage of about 16,000A and at a power of over 1000Kv, which exceeds capacities of the known electric arc vacuum heat sources.

The described apparatus provides for the adjustment of the power concentration in the heating zone on the surface of the workpiece being treated by altering the electric arc length and pressure within the evacuated chamber. It also makes it possible to after the configuracion of the heating zone by the use of means more simple than those applied at present of magnetic focusing and scanning for the electric arc.

The specific features of the apparatus just mentioned make provision for the explosive-proof process of melting metals, in particular that of titanium, when the power concentration in the heating zone is high enough for melting metals, but insufficient for the destruction of the water-cooled metal wall of the workpiece support means in the form of a mold. The elongated shape of the heating zone, ensured by the given apparatus, makes it possible to obtain flat ingots in molds, to subject large surfaces to heat treatment and run other advanced processes.

The apparatus is capable of functioning within the evacuated chamber at a pressure of 0.5 mm Hg to 5.0 mm Hg, which is practically impossible for other high temperature vacuum heaters, such as electron-beam guns, devices using non-consumable hot cathodes and arc plasmatrons. The described apparatus may also use as a power supply any D.C. source being in wide usage to supply power to arc furnaces for melting of metals. This facilitates the construction of new foundry installations and provides for fitting the functioning installations with electric arc vacuum heating devices in accordance with the present invention.

Further objects and advantages of the present invention will now be explained in greater detail with reference to embodiments thereof which are represented in the accompanying drawings, wherein.

Figure 1:
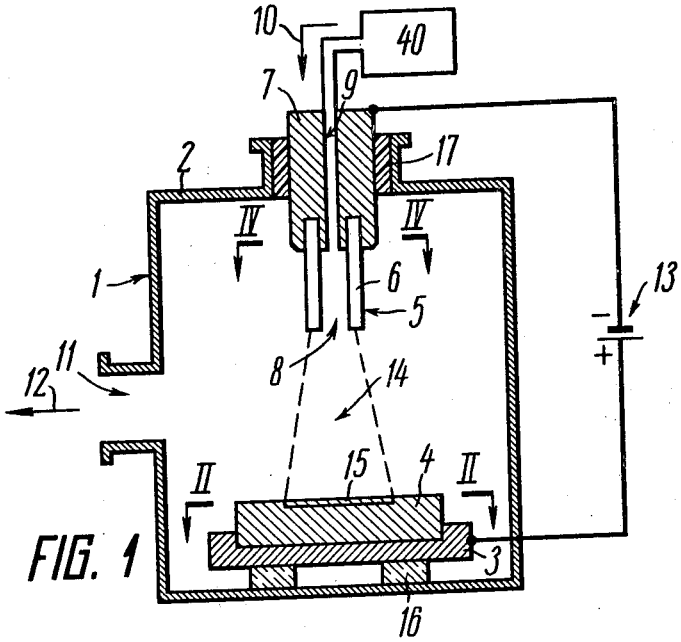
FIG. 1 is an elevational view, in cross-section, of an electric arc heating vacuum apparatus for treating a workpiece of an electrically conducting material in accordance with the invention.

The electric arc heating vacuum apparatus for treating a workpiece of an electrically conducting material comprises an evacuated chamber 1 (FIG. 1) with walls 2 of an electrically conducting material, an electrically conducting support means 3 on which a workpiece 4 being treated, made of an electrically conducting material, is mounted within the chamber, and a hollow hot cathode 5 of a thermo-emissive alloy, in the described embodiment this being tungsten with additives of thorium, lanthanum or yttrium oxides. The hollow hot cathode is formed of rods 6 fixed within a cathode support 7 of an electrically conducting material. The rods 6 define a cathode inner space 8 facing the workpiece 4 being treated. The depth of the cathode inner space 8, defined by the rods 6, is at least 1.5 times as much as its smallest cross section. The cathode support 7 has a channel 9 for delivering a flow of gas therethrough into the cathode inner space 8 in the direction of an arrow 10.

The evacuated chamber 1 has an opening 11 for pumping out the gas therethrough in the direction of an arrow 12. This makes it possible to maintain a preset pressure value within the evacuated chamber 1. The channel 9 provides for the neccessary pressure difference between the cathode inner space 8 and the evacuated chamber 1 space.

The cathode support is connected to the negative terminal of a D.C. power source 13, and the electrically conducting support means 3 of the workpiece 4 being treated is connected to the positive terminal of the D.C. power source 13. The D.C. power source makes it possible to establish an electric arc 14 between the workpiece 4 being treated and the hollow hot cathode 5. The workpiece 4 being treated is subjected to the electric arc 14 heat along a heating zone 15. The electrically conducting support means of the workpiece being treated is electrically insulated from the walls 2 of the evacuated chamber 1 by an isolator 16. Another insulator formed of an insulating bush 17 is used to electrically insulate the cathode support 7 from the walls 2 of the evacuated chamber 1, as well as to provide for an air-tight connection of the cathode support 7 with the evacuated chamber 1.

Figure 2:
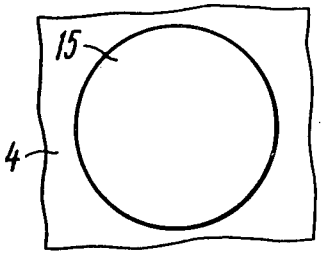
FIG. 2 is a view taken along the line II—II in FIG. 1 showing a heating zone on the surface of the workpiece being treated in accordance with the invention.

FIG. 2 illustrates a heating zone 15 of a circular shape, which is established on the surface of the workpiece 4 being treated under the action of energy generated by the electric arc 14 (FIG. 1).

Figure 3:
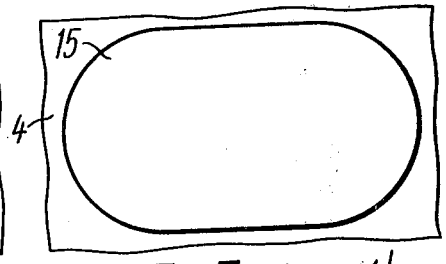
FIG. 3 is a view similar to FIG. 2, but showing another a version of the heating zone on the surface of the workpiece being treated in accordance with the invention.

FIG. 3 illustrates a heating zone 15 of an oval form, which is established on the surface of the workpiece 4 being treated under the action of energy generated by the electric arc 14 (FIG. 1).

Figure 4:
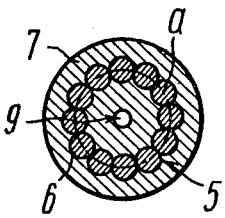
FIG. 4 is a cross sectional view taken along the line IV—IV in FIG. 1 showing a cathode support with rods fixed therein in accordance with the invention.

FIG. 4 shows a cross-sectional view taken along the line IV—IV (FIG. 1) wherein one of the possible versions of arranging the rods 6 of the hollow hot cathode 5 within the cathode support 7 is illustrated. The cathode support 7 is provided with the channel 9 for feeding gas therethrough into the cathode inner space 8 (FIG. 1). The rods 6 (FIG. 4) are fixed within the cathode support 7 and fastened thereto with one of their ends, these ends of the rod 6 being closely arranged in circumference "*a*". Such arrangement of the rods 6 causes the heating zone 15 (FIG. 2), formed on the surface of the workpiece 4 being treated, to have a circular form.

The heating zone 15 (FIG. 2) will also have a circular form if the rods (FIG. 5) are fixed within the cathode support 7 so that a clearance 18 is provided between at least one pair of adjacent rods 6. The cathode support also has the channel 9 for feeding gas therethrough into the cathode inner space 8 (FIG. 1).

Figure 6:
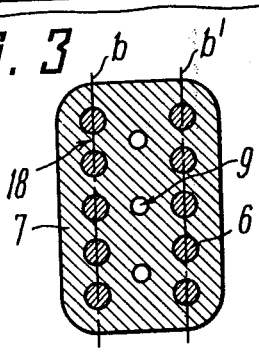
FIG. 6 is a view similar to FIG. 4, but showing another version of the arrangement of rods in the cathode support in accordance with the invention.

If the ends of the rod 6, fixed within the cathode support 7 (FIG. 6), are arranged along lines "*b*" and *b'* two parallel lines spaced apart, the heating zone 15 (FIG. 3) established on the surface of the workpiece 4 being treated will have an elongated or oval form. The cathode support 7 (FIG. 6) has three channels 9 intended for more uniform distribution of gas along the inner cathode space 8 (FIG. 1). There are clearances 18 between the pairs of adjacent rods 6 forming the hollow hot cathode 5 (FIG. 6).

Figure 7:
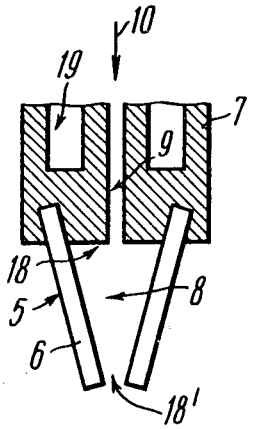
FIG. 7 is an enlarged elevational view, in cross-section, showing the part of the cathode support with the rods fixed therein in accordance with the invention.

FIG. 7 shows still another version of arranging the rods within the cathode support 7 which is provided with cooling inner surfaces 19 and the channel 9 for feeding gas therethrough into the cathode inner space in the direction of the arrow 10.

The unfixed ends of the rods 6 converage, this being a cause for the smaller clearance 18' between the unfixed ends of the rod 6 facing the workpiece 4 being treated (FIG. 1), as compared to the clearance 18 between the opposite ends of the rods 6 fixed within the cathode support.

Figure 8:
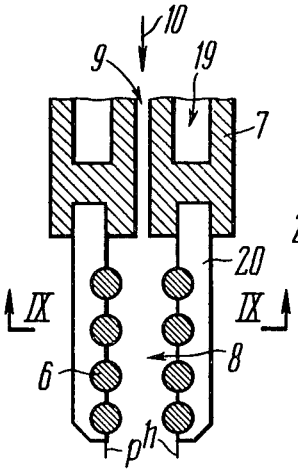
FIG. 8 is a view similar to FIG. 7 but showing the part of the cathode support having the rods fixed therein with the help of the support stands in accordance with the invention.

FIG. 8 shows one of the possible versions of affixing the rods 6 to the cathode support 7, the procedure being carried out by supporting stands 20.

Figure 9:
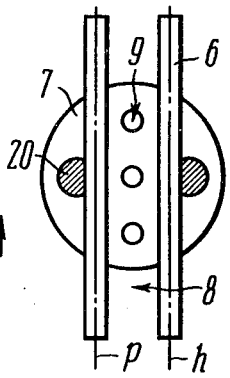
FIG. 9 is a cross-sectional view taken along the line IX—IX in FIG. 8 in accordance with the invention.

Each stand 20 is used to affix a group of four rods 6 to the cathode support 7 along one of the longitudinal planes "*p*" or "*h*". The rods 6 are arranged along two planes "*p*" and "*h*" in spacial relationship. The channels 9 within the cathode support 7 are used for delivery of gas therethrough into the cathode inner space 8 in the direction of the arrow 10. FIG. 9 shows the cross section taken along the line IX—IX in FIG. 8, illustrating the cathode support 7 as having three channels for feeding the gas therethrough into the cathode inner space 8. Such an arrangement of the rods 6 within the cathode support 7 makes it possible to obtain a heating zone 15 (FIG. 3) on the surface of the workpiece 4 being treated having an elongated form. This can be done without increasing the cross-section of the cathode support 7, according to the version shown in FIG. 6.

Figure 10:
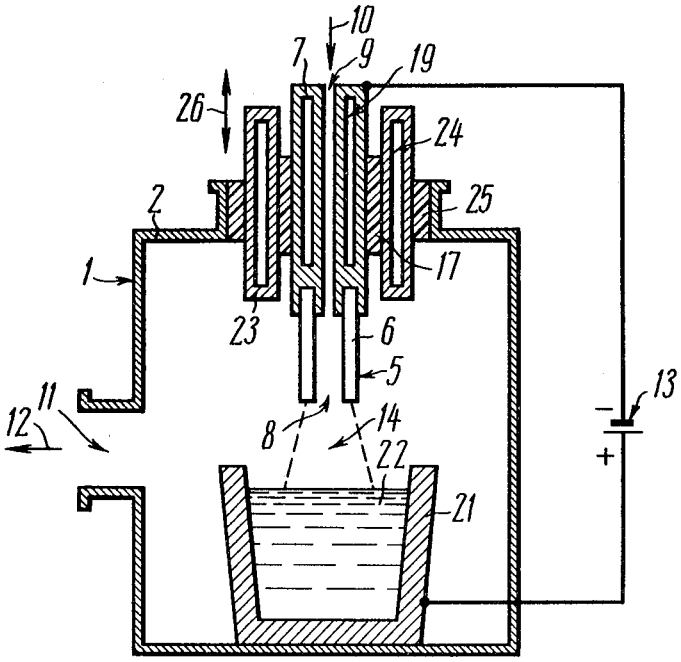
FIG. 10 is an elevational view, in cross-section, showing another version of an electric arc heating vacuum apparatus in accordance with the invention.

FIG. 10 illustrates a sectional view, in elevation, of an embodiment of the electric arc heating vacuum apparatus, said apparatus being used for heating liquid electrically conducting materials, such as melted metals.

Mounted within the evacuated chamber 1 with the walls 2 are electrically conducting support means in the form of a ladle 21 with a workpiece being treated (heated) such as a liquid electrically conducting material 22, and the hollow hot cathode 5 with the rods 6 thereof being fixed within the cathode support 7 and defining the cathode inner space 8. The cathode support 7 is arranged coaxially within a section of an electrically conducting conduit 23 provided with coolant passages 24.

The insulated bush 17 provides for a film and air-tight coupling of the cathode support 7 and the electrically conducting conduit 23, and also electrically insulates them from each other. Another insulated bush 25 provides for electrical insulation of the electrically conducting conduit 23 from the walls 2 of the evacuated chamber 1, and also from the electrically conducting ladle 21 with the liquid electrically conducting material 22 being heated, which ladle contacts the walls 2.

The electrically conducting conduit 23, being electrically neutral, performs the function of an electric screen which makes it possible to prevent spurious electric discharges taking place between the negatively charged cathode support 7 and the positively charged liquid material 22, and between the electrically conducting ladle 3 and the walls 2 of the evacuated chamber 1.

Apart from performing the insulating function between the electrically conducting pipe or conduit 23 and the walls 2 of the evacuated chamber 1, the insulated bush 25 is used for establishing a vacuum seal therebetween. This allows the stepwise shifting of the electrically conducting conduit 23 within the cathode support 7 towards the material 22 being heated and in the opposite direction therefrom (these directions are shown by the arrow 26). The stepwise feed motion of the electrically conducting conduit 23 and the cathode support 7 is effected by the use of a drive mechanism (not shown), which, if required, may also be utilized to ensure fixed mounting of the electrically conducting pipe 23 within the cathode support 7 within the evacuated chamber 1.

The cathode support 7 has coolant passages 19 and the channel 9 for feeding the gas therethrough into the cathode inner space 8 in the direction of the arrow 10. The opening 11 in the wall 2 of the evacuated chamber 1 is used for pumping out the gas therethrough in the direction of the arrow 12 with the help of a pumping system (not shown in FIG. 10).

Figure 11:
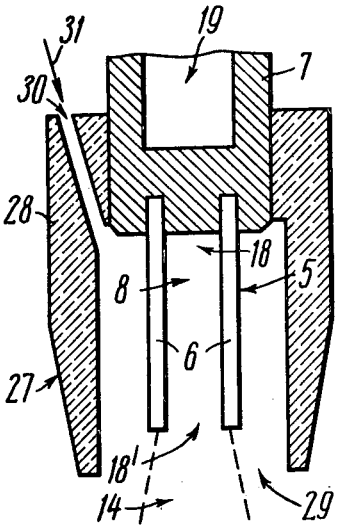
FIG. 11 is an enlarged, elevational view, in cross-section, showing the part of the cathode support with rods and a jacket of a heat resistant material fixed thereupon in accordance with the invention.

FIG. 11 is a longitudinal, sectional view of a part of the cathode support 7 with the coolant recess 19. Fixed to the cathode support 7 are the rods 6 of the hollow hot cathode 5, defining the cathode inner space 8. The hollow hot cathode 5 is enveloped by a jacket 27 of a heat resistant material.

A wall 28 of the jacket 27 has a first opening 29 facing the workpiece 4 being treated (FIG. 1). The opening 29 is used for the electric arc 14 to pass therethrough between the hollow hot cathode 5 and the workpiece 4 being treated (FIG. 1).

The wall 28 (FIG. 11) of the jacket 27 also has a second opening 30. This opening 30 is used for feeding the gas therethrough in the direction of an arrow 31, the gas passing into the cathode inner space 8 through the clearances 18' and 18 between adjacent rods 6. The jacket 27 renders protection to the hollow hot cathode 5 from the sprays of the melted material being treated (FIG. 10), and directs the flow of gas passing out from the opening 30 through the clearance 18' between the rods 6 into the cathode inner space 8.

Figure 12:
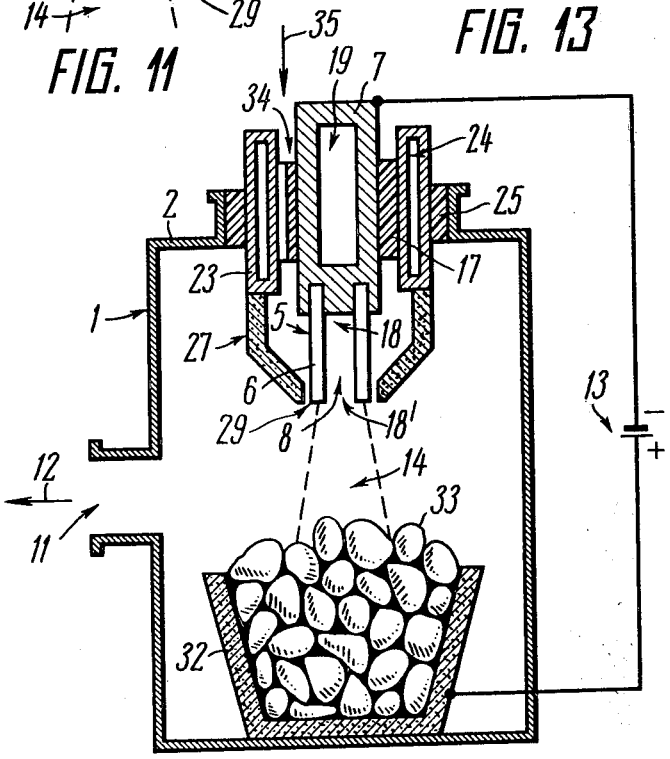
FIG. 12 is an elevational view, in cross-section, showing another embodiment of an electric arc heating vacuum apparatus in accordance with the invention.

FIG. 12 is a general, longitudinal sectional view of the electric arc heating vacuum apparatus wherein mounted within the evacuated chamber 1 with the walls 2 is an electrically conducting melting-rod 32 with a solid electrically conducting material 33 being remelted. The gas is fed into the cathode inner space 8 through a channel 34 in the direction of an arrow 35, and through the clearances 18' between the rods 6.

Figure 13:
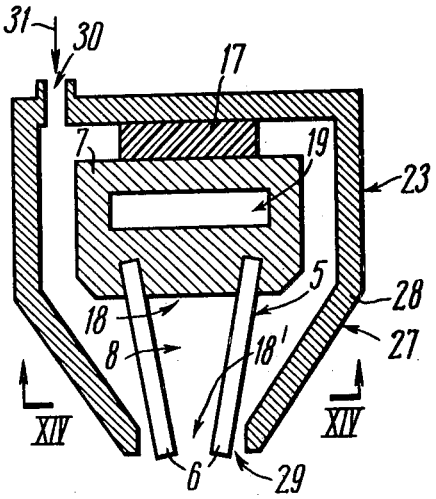
FIG. 13 is an enlarged elevational view, in cross-section, showing the cathode support with rods arranged within the jacket made integral with an electrically conducting pipe in accordance with the invention.

FIG. 13 shows the rods 6 converge in the direction of the workpiece 4 being treated (FIG. 1). As a result of this the clearance 18' (FIG. 13) between the ends of the rods 6, facing the workpiece 4 being treated (FIG. 1), is smaller than the clearance 18 between the opposite ends of the same rods 6, which are fixed in the cathode support 7 (FIG. 13).

The jacket 27, made of a heat resistant material, is made integral with the electrically conducting pipe 23.

The jacket 27 serves to protect the hollow hot cathode 5 from sprays of the melted material 33 (FIG. 12) and prevents at the same time spurious electric discharges between the cathode support 7 and the walls 2 (FIG. 1) of the evacuated chamber 1. It is also used to direct the flow of gas passing out of the opening 30 (FIG. 13) through the clearances 18 and 18' between the rods 6 into the cathode inner space 8.

Figure 14:
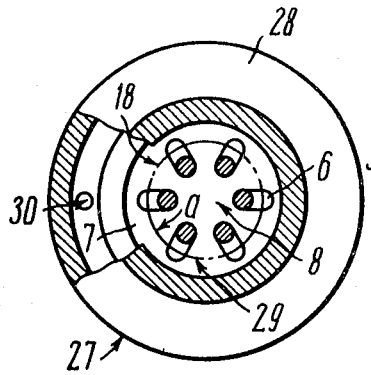
FIG. 14 is a cross-sectional view taken along the line XIV—XIV in FIG. 13 in accordance with the invention.

FIG. 14 is a cross-sectional view taken along the line XIV—XIV in FIG. 13 showing a bottom view of the rods 6, the rods having one of their ends fixed in the cathode support 7, and being mounted so that the clearance 18' (FIG. 13) between the ends of the rods 6 facing the workpiece 4 being treated (FIG. 1) is smaller than the clearance 18 between the ends of the rods 6 fixed in the cathode support 7 (FIG. 14).

The zone 15 (FIG. 2), produced by the given hollow hot cathode on the surface of the workpiece 4 being treated, has a circular form since the ends of the rods 6, fixed in the cathode support 7 (FIG. 14), are arranged in a circle "*a*".

The walls 28 of the jacket 27 have the first opening 29 for the electric arc 14 to pass therethrough (FIG. 1), and the second opening 30 (FIG. 14) for delivering a flow of gas therethrough into the jacket 27 and afterwards through the clearances 18 and 18' (FIG. 13), between the rods 6, into the cathode inner space 8.

Figure 15:
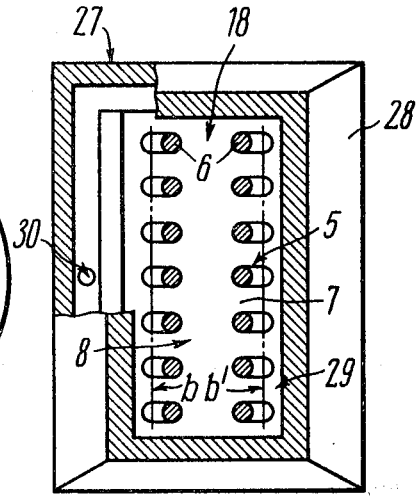
FIG. 15 is an elevational view, in cross-section, partially broken away, of version of the rods arrangement within the jacket in accordance with the invention.

FIG. 15 is a cross-sectional view of the jacket 27 with the rods 6 being mounted therein. The rods 6 have their ends fixed within the cathode support 7 so that the clearance 18' (FIG. 13) between the ends of rods 6 facing the workpiece 4 being treated (FIG. 1) is smaller than the clearance 18 between the rods 6 fixed within the cathode support 7 (FIG. 15). Thus the rods 6 converge towards the workpiece 4 being treated (FIG. 1). The heating zone 15 (FIG. 15), produced on the surface of the workpiece 4 being treated by the cathode of the given form, has a respective elongated form since the ends of the rods 6, fixed in the cathode support 7 (FIG. 6), are arranged along two parallel lines "*b*" and "*b'*". The first opening 29 (FIG. 15) in the walls 28 of the jacket 27 has a rectangular form, the second opening 30 (FIG. 15) is provided for the delivery of gas therethrough into the cathode inner space 8 through the clearance 18 between the rods 6.

Figure 16:
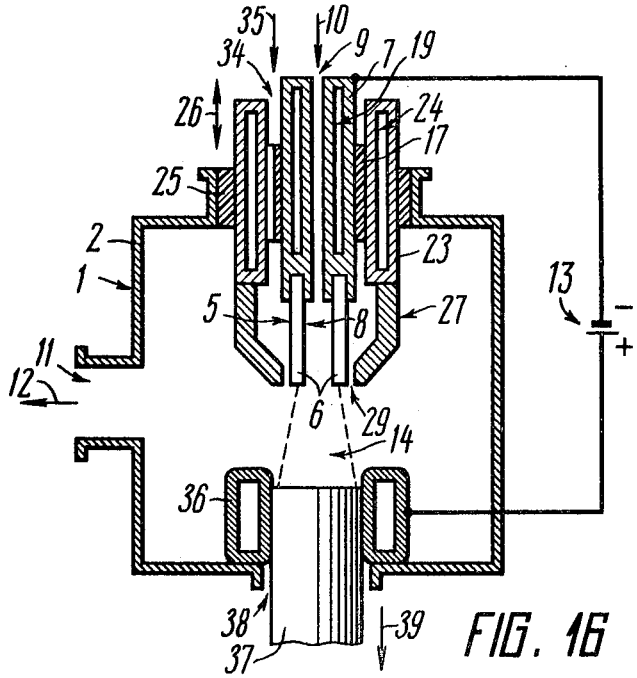
FIG. 16 is an elevational view, in cross-section, showing another embodiment of an electric arc heating vacuum apparatus for treating workpieces of electrically conducting materials in accordance with the invention.

FIG. 16 is a general, longitudinal sectional view of the electric arc heating vacuum apparatus used for the casting process. Mounted within the evacuated chamber 1, having the vent 11 for pumping out the gas therethrough in the direction of the arrow 12, is an electrically conducting support means such as a water-cooled mold 36 with an ingot 37 being cast therein, which, upon cessation of the casting process, is removed from the evacuated chamber 1 through a port 38 in the direction of the arrow 39. The insulated bush 17 is provided with the conduit 34 for feeding a flow of gas therealong into the cathode inner space 8 in the direction of the arrow 35.

The hollow hot cathode 5 is arranged within the casing 27 secured onto the electrically conducting conduit 23. The casing 27 protects the hollow hot cathode from sprays of the metal being smelted in the mold 36. It also serves to direct a flow of gas passing out of the conduit 34 into the cathode inner space 8.

The cathode support 7, rigidly connected with the electrically conducting conduit 23 through the insulated bush 17, being capable of moving along the insulated bush 25, the direction of its motion being indicated by the arrow 26, which provides for tight sealing. The displacement of the cathode support 7 together with the electrically conducting conduit 23 is effected by a driving mechanism (not shown).

FIG. 1 shows a gas supply means, such as system 40, e.g. a tank with compressed gas therein, for delivery of a flow of gas therefrom to the cathode inner space 8 through an opening 9 in the direction of the arrow 10. Similar gas supply means are used in other embodiments of the apparatus, but are not shown in FIGS. from 2 to 16.

According to the invention, the electric arc heating vacuum apparatus operates as follows.

The air is pumped out of the chamber 1 (FIG. 1) by vacuum pumps (not shown in FIG. 1) through the vent 11 in the direction of the arrow 12 until the pressure in the evacuated chamber 1 is below 20 mm Hg, preferably down to a pressure of $10^{-1}$ mm Hg to $10^{-3}$ mm Hg. A flow of gas, preferably argon or helium, is delivered into the cathode inner space 8 through the conduit 9 within the cathode support 7 in the direction of the arrow 10 in an amount sufficient to create a pressure difference between the cathode inner space 8 and the evacuated chamber 1. Ordinarily the pressure within the cathode inner space 8 is dozens of times as much as that within the evacuated chamber 1. The higher the volume flow rate of the gas, the higher is the working pressure within the evacuated chamber 1, the flow rate ranging from 0.01 to 1.0 $m^3$/hr.

The gas, delivered through the cathode support 7 along the conduit 9, is continuously pumped out of the evacuated chamber 1 through the vent 11 in the direction of the arrow 12. Thus the required pressure for treating the workpiece 4 is maintained within the evacuated chamber 1, ordinarily within the range of from 20 mm Hg to $10^{-2}$ mm Hg.

For the electric arc 14 to be established between the hollow hot cathode 5 and the workpiece 4 being treated, the neccessary pre-ionization of the gas within the cathode innerspace 8 should be carried out, as well as heating of the rods 6 up to a temperature of over 2000° C., to a point producing thermionic emission. This is attained in the following manner. D.C. voltage from the power source 13 is applied between the workpiece 4 being treated and the hollow hot cathode 5. The D.C. power source 13 has its positive terminal connected to the electrically conducting support means 3 with the workpiece 4 being treated, and its negative terminal being connected to the cathode support 7 with the hollow hot cathode 5 fixed thereto. The preferable voltage applied from the power source 13 should range from 30 to 100 V.

Formation of the electric arc 14 is achieved by applying high frequency voltage from a stand-by power source (not shown) between the cathode support 7 and the electrically conducting support means 3. The stand-by power source may be deenergized once the main electric arc 14 is established and maintained thereafter by the D.C. source 13.

After the rods 6 of the hollow hot cathodes have been heated to the point of temperature producing active thermionic emission, and upon completion of the ionization of the gas in the cathode inner space 8, defined by the rods 6, and after connecting the negative terminal of the D.C. source 13 to the cathode support 7 and the positive terminal of the same source 13 to the electrically conducting support means 3 with the workpiece 4 being treated, the electric arc 14 once started is maintained across the electric field between the rods 6 and the workpiece 4 being treated. Electrons are emitted from the side surface of the rods 6 defining the cathode inner space 8, attracted by positive ions contained in plasma within the space 8, and, thereby, cause additional ionization of the neutral atoms and molecules of the gas being continuously delivered into the cathode inner space 8. In turn, the gas (plasma) ionized in the cathode inner space 8, emits electrons towards the workpiece 4 being treated, thereby maintaining the electric arc 14 between the rods 6 of the hollow hot cathode 5 and the workpiece 4 being treated.

The number of rods 6, forming the hollow hot cathode 5 and the cross-section thereof, as well as the cross-sectional area of the cathode inner space 8, is selected in view of the maximum power of the electric arc 14. It has been experimentally established that the rods 6, made of lanthanum-containing tungsten (W + 1% $La_2O_3$) 10 mm in diameter, have a long service life at a current intensity of about 1000 A. By increasing the power of the electric arc 14, it is necessary to increase not only the cross-section of the rods 6, but the cross-sectional area of the cathode inner space 8 as well. For example, to operate at a current intensity within the range from 500 to 2000 A, suffice it to arrange the rods 6 (FIG. 4) in the circle "*a*" with an internal diameter of 10 mm to 12 mm. With the current intensity, however, ranging from 8000 to 15000 A, it is necessary to have the internal diameter of the cathode inner surface 8 (FIG. 1) within the range of 45 to 50 mm.

An increase in the current intensity of the electric arc 14 in the proposed apparatus, results in a higher voltage of the electric arc 14 from 3 to 5$^V$ per each 1000 A. The voltage of the electric arc 14 also considerably increases as the pressure within the evacuated chamber 1 goes down, and may be well over 100 V.

Since the vacuum system usually operates at a constant rate of pumping out the air of the evacuated chamber 1, the pressure within the evacuated chamber 1, and consequently, the voltage and power of the electric arc 14, may be adjusted by altering the flow rate of gas being delivered through the conduit 9 within the cathode support 7. Thus, at an invariable operating rate of the vacuum pump, for instance a flow rate of gas of 0.8 $m^3$/hr, an electric arc 14 is established having a current intensity of 3000 A, voltage of 28 V, and a pressure within the evacuated chamber of 1.0 mm Hg. The flow rate of gas being 0.05 $m^3$/hr, the electric arc 14 has a current intensity of 3000 A, voltage of 45 V and a pressure of 0.1 mm Hg. With the pressure being reduced in the evacuated chamber 1, the electric arc 14 is caused to disperse with hardly any power effect on the material being treated. Therefore, by adjusting the pressure within the evacuated chamber 1, as well as the flow rate of gas, the proposed apparatus may be adapted for use within a broad range of power and operating conditions.

The rods 6 (FIG. 4) of the hollow hot cathode 5 are fixed in the cathode support 7 along the circle "*a*" which results in the circular shape of the heating zone 15 (FIG. 2) on the surface of the workpiece 4 being treated. The length of the rods 6 (FIG. 1), forming the cathode inner space 8, is at least 1.5 times as much as the smallest cross-sectional area of the cathode inner space 8. This is due to the fact that the zone of gas ionization within the cathode inner space 8 is above the unfixed end of the rods 6 at a distance nearly equal to the cross-sectional area of the cathode inner space 8. With the length of the rods 6 exceeding the cross-sectional area of the cathode inner space 8 by more than five times, the gas blasting of the ionized zone withint the cathode inner space 8 is impaired. This, however, does not prevent the apparatus from operating.

In case the ends of the rods 6, fixed in the cathode support 7 (FIG. 6), are arranged along two parallel lines *b* and *b'*, the heating zone 15 (FIG. 3) on the surface of the workpiece 4 being treated will assume the oval shape.

Higher power concentration in the heating zone 15 (FIG. 1) may be obtained by arranging the rods 6 (FIG. 7) so that they converge towards the workpiece 4 being treated (FIG. 4). This will cause compression of the electric arc 14 column, which, in turn, will lead to the reduction of the surface area of the heating zone 15 on the surface of the workpiece 4 being treated, and will also result in a higher density of the heat flux on the heating zone 15. If the ends of the rods 6 fixed in the cathode support 7 (FIG. 14) converging towards the workpiece 4 being treated (FIG. 1) are arranged in a circle "*a*", the heating zone 15 (FIG. 2) will assume the circular shape.

If, however, the fixed ends of the rods 6 (FIG. 15) converge towards the workpiece 4 being treated (FIG. 1) are arranged along the two parallel lines *b* and *b'* (FIG. 15), the heating zone 15 (FIG. 3) on the surface of the workpiece 4 being treated will assume the elongated form.

The ionization process and formation of the electric arc 14 (FIG. 1) within the cathode inner space 8 (FIG. 8) are effected as described above. The herein described arrangement of the rods 6 (FIG. 8), fixed to the cathode support 7 by means of the support stands 20 of the electrically conducting material, makes it possible to increase the emitting surface of the cathode inner space 8 formed by the rods 6, as compared to the fixing technique alternative shown in FIG. 6. This, in turn, makes it possible to obtain a heating zone 15 (FIG. 1) on the surface of the workpiece 4 being treated which assumes the shape of a very elongated oval (not shown).

In view of the fact that it is possible to introduce alterations in the shape and surface area of the heating zone 15 on the surface of the workpiece 4 being treated, the treatment can be afforded to workpieces of various shapes. The ingots 37 can be melted in a mold 36 (FIG. 16) of both circular and longitudinal section sections (not shown).

FIG. 10 shows a general view of an electric arc heating vacuum apparatus used for heating the electrically conducting liquid material 22.

After the gas is pumped out of the evacuated chamber 1 through the vent 11 in the direction of the arrow 12, and the inert gas is delivered through the conduit 9 (arrow 10) into the cathode inner space 8, and on connecting the D.C. power source to the hollow hot cathode 5 and to the ladle 21, the formation of the electric arc 14 between the hollow hot cathode 5 and the workpiece 4 being treated is carried out by contacting with at least one rod 6 the workpiece being treated. This is accomplished by driving the cathode support 7 and the rigidly fixed thereto electrically conducting conduit 23 along the insulated bush 25 towards the workpiece 4 being treated. The driving mechanism, associated with the cathode support 7, provides for the movement of the latter along the insulated bush 25, not shown in FIG. 10.

The electrically conducting conduit 23 with inner coolant passages 24, which is electrically insulated both from the cathode support 7 and the electrically conducting ladle 21 with the liquid electrically conducting material 22 therein, performs the function of an electric screen. It should be noted that in some cases the ionization of the gas is observed within the evacuated chamber 1 during the operating cycle of the electric arc heating vacuum apparatus, which causes current leakage from the cathode support 7 onto the walls 2 of the evacuated chamber 1 being electrically connected to the ladle 21. With the aid of the electrically conducting conduit 23, the cathode support 7 with the cathode 5 are introduced into the evacuated chamber 1. By shifting the conduit 23 with the cathode support 7 and the hollow hot cathode 5 along the axis of the electric arc 14, the length of the electric arc is varied. This procedure is required not only for the electric arc, but also for altering the power concentration within the heating zone 15 (FIG. 2), as well as for facilitating charging and discharging of the liquid material 22 (FIG. 10) being treated. The distance between the hollow hot cathode 5 and the material 22 being treated i.e., the length of the electric arc 14, may be altered within a broad range of from 5 to 100 centimeters. By altering the length of the electric arc 14, it is possible to adjust the amount of energy evolved within the heating zone 15 (FIG. 2). This broadens the scope of application of the electric arc heating vacuum apparatus in accordance with the invention. For example, the proposed apparatus, provided the length of the electric arc 14 ranges from 5 to 20 cm, may be used as a high intensity heating source for melting refractory metals. With the length of the electric arc 14 being over 20 cm, the apparatus may be suitably used as a heat dispersing which prevents the workpiece 4 being treated (FIG. 1) from reaching the melting point, this being an important factor during heat treatment of the workpiece 4.

In the course of melting solid electrically conducting materials 33 (FIG. 12), the cathode 5 is exposed to sprays and vapors of the melted material 33. Therefore, the cathode 5 is provided with the jacket 27 (FIG. 11) made of a heat resistant material, or with the jacket 27 (FIG. 12) of a heat-resistant electrically conducting material, with the purpose of prolonging its service life.

Figure 5:
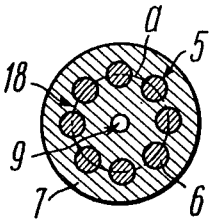
FIG. 5 is a view similar to FIG. 4, but showing another version of the arrangement of rods in the cathode support in accordance with the invention.

A flow of gas is delivered into the cathode inner space 8 through the conduit 34 in the direction of the arrow 35 within the insulated bush 17. The clearance 18 is to be provided between at least one pair of adjacent rods 6 (FIG. 5), which ensures the passage of gas into the cathode inner space 8 from the opening 34 (FIG. 12). The jacket 37 serves to direct the gas from the conduit 34 through the clearance 18 between the rods 6 into the cathode inner space 8 (FIG. 5). The first opening 29 (FIG. 11) in the walls 28 of the jacket 27, facing the workpiece 4 being treated (FIG. 1), is intended for the electric arc 14 to pass therethrough (FIG. 11).

The fact that the jacket 27 (FIG. 13) is made of an electrically conducting material makes it possible to make said jacket integral with the electrically conducting conduit 23. The gas in this case will pass through the second opening 30 in the direction of the arrow 31, made in the wall of the electrically conducting conduit 23 which is the extension of the wall 28 of the jacket 27. Such a structural arrangement is only expedient when the cathode support 7 and the hollow hot cathode 5 are mounted within the evacuated chamber 1.

The electric arc heating vacuum apparatus for melting solid materials 22 (FIG. 12) within the melting-rod 32 operates as described above, except that the gas is delivered into the cathode inner space 8 not through the cathode support 7 but through the conduit 34 between the cathode support 7 and the electrically conducting conduit 23 in the direction of the arrow 35. Due to the jacket 27 of the electrically conducting material, the electric arc 14 may be established between the cathode 5 and the workpiece 4 being treated by pre-exciting a low-power electric arc (not shown) between the hollow hot cathode and the jacket 27 by applying a D.C. voltage from a stand-by D.C. power source (not shown). The stand-by D.C. power source is deenergized once the steady electric arc 14 is established, the arc 14 being maintained thereafter by the D.C. power source 13.

The electric arc heating vacuum apparatus, shown in FIG. 16, is used for casting the ingot 37 in the electrically conducting mold 36. In this case the gas supply into the cathode inner space 8 is effected through the conduit 9 within the cathode support 7, the gas being fed thereinto in the direction of the arrow 10, and through the conduit 34 between the cathode support 7 and the electrically conducting pipe 23 in the direction of the arrow 35.

This makes possible the delivery of gas into the cathode inner space 8, said gas having a low ionization potential, i.e. argon. The gases, delivered into the evacuated chamber 1 through the conduit 34, are of different types, such as hydrogen, nitrogen, ammonia and methane, this being required for metallurgical reactions.

After the gas is pumped out through the vent 11 in the direction of the arrow 12, and the D.C. source 13 is electrically connected to the cathode support 7 and to the electrically conducting mold 36 with the ingot 37 therein, the electric arc 14 is formed by bringing into contact at least one rod 6 with the ingot 37 being treated. The contacting is carried out by shifting the electrically conducting conduit 23 along the insulated bush 25 in the direction of the arrow 26. After the electric arc 14 is established, the electrically conducting pipe 23 is driven in reverse direction from the ingot 37 and is then fixed at a preset distance therefrom with the help of a driving mechanism (not shown in FIG. 16). The ingot 37 undergoes further treatment carried out in the above-described manner. After the casting process is completed, the ingot 37 is removed from the evacuated chamber 1 through the port 38 in the direction of the arrow 39.

The operation of the apparatus will now be described by the following examples.

EXAMPLE 1

Mounted within the water-cooled evacuated chamber 1 (water cooling system is not shown in FIG. 1) on a copper plate 3 insulated from the walls 2 of the evacuated chamber 1 is the workpiece 4 being treated, the workpiece being in the form of a molybdenum ingot 250 mm in width and 270 mm in height. The hollow hot cathode 5 is formed of eight rods 6 120 mm in length and 10 mm in diameter, the rods being made of lanthanum-containing tungsten (W + 1% $La_2O_3$). The ends of the rods 6 (FIG. 6) are fixed in the cathode support 7 along the segments "*b*" and "*b*'" of two parallel lines 48 mm in length, spaced from each other at a distance of 25 mm. The clearance 18 between the adjacent rods 6 in each row is 6 mm.

The water-cooled cathode support 7 (FIG. 1), made of copper, is introduced into the evacuated chamber 1 through the insulated bush 17.

A flow of argon gas is delivered into the cathode inner space 8 between the two rows of the rods 6 along two conduits 9 disposed in the cathode support 7.

By producing a short circuit between the hollow hot cathode 5 and the flat surface of the workpiece 4 being treated, the electric arc 14 is initiated and sustained during, fifteen-minute period at the following parameters: the pressure within the evacuated chamber 1 is 0.8 mm Hg, the flow rate of the argon is 0.3 $m^3$/hr, the length of the electric arc 14 is 180 mm, the electric arc 14 amperage is 6000 A, and the electric arc 14 voltage is 42 V.

Forming on the surface of the workpiece 4 being treated is a bath of melted metal which flows out of holes fitted in the workpiece 4 being treated. The bath is 40 mm deep, and its cross-section in the horizontal plane has a shape similar to that shown in FIG. 3, illustrating a heating zone 15 180 mm in length and 100 mm in width.

EXAMPLE 2

Mounted within the evacuated chamber 1 (FIG. 12) is the (the melting pot 32, made of graphite, with a melt stock 33 in the form of waste lumps of the titanium alloy disposed thereinside. The hollow hot cathode 5 is composed of twelve rods 6, which are made of lanthanum-containing tungsten 10 mm in diameter and 120 mm in length, fixed in the water-cooled cathode support 7, water cooling thereof being made possible due to the coolant passage 19. The ends of the rods 5, fixed in the cathode support 7 (FIG. 5), are arranged in a circle "*a*" 60 mm in diameter. The water-cooled electrically conducting conduit 23 (FIG. 12), which is 150 mm in diameter, performs the function of an electric screen, and is rigidly coupled with the cathode support 7 through the insulated bush 17. The jacket 27, made of graphite, is affixed on the conduit 23 so that the rods 6 jut out for 20 mm from the first opening 29 of the jacket 27, facing the solid material 33 being remelted, said material consisting of waste lumps of the titanium alloy.

The opening 29 is 85 mm in diameter. The inert gas, argon, is delivered into the conduit 34 between the cathode support 7 and the electrically conducting pipe 23.

The electric arc 14 is initiated between the hollow hot cathode 5 and the melting stock within the melting-pod 32, said arc being sustained during an eleven-minute period at the following parameters: the pressure within the evacuated chamber 1 is 0.5 mm Hg, the flow rate of the argon gas is 0.5 $m^3$/hr, the length of the electric arc 14 is 600 mm, the amperage of the electric arc 14 is 16000 A, and the voltage is 66 V.

In the course of melting, a circular bath of melted metal 650 mm in diameter is formed on the surface of the solid material 33, the shape of the bath corresponding to that of the heating zone 15 (FIG. 2). A cast piece of 100 kg is obtained from the melted mass of metal.

EXAMPLE 3

Mounted within the water-cooled evacuated chamber 1 (FIG. 16) (the water-cooling system not shown), is the water-cooled copper mold 36, adapted for casting an ingot 37 280 mm in diameter from tatanium cuttings used as the melt stock by way of continuous addition of said melt stock into the mold 36 and retracting the ingot 37 therefrom. The hollow hot cathode 5 is composed of six rods 6 10 mm in diameter and 80 mm in length, and made of lanthanum-containing tungsten. The ends of the rods 6, fixed in the cathode support 7 (FIG. 5), are arranged in a circle "*a*" 25 mm in diameter. The cathode support 7 (FIG. 16) is mounted within a watercooled electrically conducting conduit 23 125 mm in diameter. Secured to the lower end of the conduit 23 is the water-cooled (the water-cooling system is not shown) jacket 27 made of copper. The first opening 29 of the jacket 27, which is 42 mm in diameter, is at the same level as the lower unfixed ends of the rods 6.

Delivered along the conduit 9 to the cathode support 7 is argon gas, and along the conduit 34 is helium gas.

The electric arc 14 is sustained from 1.5 to 2 hours at the following parameters: the pressure in the evacuated chamber 1 ranges from 0.3 mm Hg to 0.6 mm Hg, the flow rate of argon is 0.15 $m^3$/hr, and that of helium is 0.1 $m^3$/hr, the length of the electric arc 14 is within the range of from 200 to 350 mm, the electric arc 14 amperage is between 3500 and 4500 A, and the voltage thereof ranging from 32 to 38 V.

The resultant ingot 37 of the titanium alloy is 1.5 m long.

The herein disclosed invention is not limited by the examples given above. The electric arc heating vacuum apparatus in accordance with the invention may be suitably applied in other processes and systems which require a high-temperature-low pressure combination in a gaseous medium (less than 20 mm Hg). To be more specific, the present invention may be recommended or use in the following processes:

in remelting, refining and preparing alloys, preferably high-grade, high-active, multicomponent alloys, in melting-and-casting furnaces provided with both ceramic crucibles and metal-melting pots;

remelting wastes of high-active alloys, such as titanium alloys, in furances provided with both skull crucibles and molds;

casting ingots of circular and rectangular sections in crystallizing furnaces in the form of end halffinished products and as a melt stock for subsequent remelting;

melting metals and alloys as well as heating the melted material in continuous melting furnaces;

heating the head parts of the circular-, and rectangular-, shaped ingot cast in vacuum molds, with the aim of rectifying the contraction cavity thereupon;

heating the melted metal in ladles and mixers during the non-furnace vacuum treatment;

refining and alloying metals and alloys by the use of active gases, such as, nitrogen or methane;

electrothermical reduction processes in liquid or gaseous phases, especially for obtaining reduction products in the form of metal ingots and alloys thereof, e.g., for carbothermical and hydrogen reduction, and non-oxidizing heating of the melt stock of high-active alloys for the subsequent plastic deformation thereof;

heat treatment of workpieces in a vacuum, especially in continuous furnaces;

high temperature caking of stock of refractory metals and alloys thereof, obtained through the powder metallurgy method; and welding, building-up welding and surface treating of a workpiece in a vacuum.

The present invention makes it possible to establish powerful electric arcs 14 effecting the workpiece 4 being treated along the surface area of the heating zone 15 of the variable shape. The invention ensures the control of the power concentration within the heating zone 15, thus making processes run in water-cooled support means 3 explosion-proof.

What is claimed is:

1. An electric arc heating vacuum apparatus for treating a workpiece made of an electrically conducting material, comprising an evacuated chamber; electrically conducting support means on which the workpiece is mounted within said chamber; a hollow hot cathode made of a thermionic alloy, mounted within said chamber and in spacial relationship with said electrically conducting support means, a cathode inner space within said hollow hot cathode facing said electrically conducting support means within said chamber; rods forming said hollow hot cathode and defining said cathode inner space, said rods having a side surface, upper ends and lower ends, said cathode inner space defined by said rods having a longitudinal dimension at least 1.5 times greater than the its smallest cross-section dimension; a cathode support, made of an electrically conducting material, secured fast with said hollow hot cathode formed of said rods within said evacuated chamber; means for delivering a flow of gas into said cathode inner space; a D.C. power source, a negative terminal of said D.C. power source being connected to said cathode support, a positive terminal of said D.C. power source being connected to said electrically conducting support means of said workpiece being treated, to initiate and sustain an electric arc between said hollow hot cathode and said workpiece being treated.

2. An electric arc heating vacuum apparatus for treating a workpiece made of an electrically conducting material as claimed in claim 1, wherein said upper ends of said rods of said hollow hot cathode are secured fast to said cathode support and said lower ends of said rods of said hollow hot cathode are facing said workpiece being treated.

3. An apparatus as claimed in claim 2, wherein said upper ends of said rods are arranged in a circle.

4. An apparatus as claimed in claim 2, wherein said upper ends of said rods are arranged along two parallel lines in spacial relationship.

5. An apparatus as claimed in claim 1, further comprising means for connecting said rods of said hollow hot cathode to said cathode support, said rods, forming said hollow hot cathode, having said side surfaces thereof fixedly attached to said means for connecting and arranged along at least two planes.

6. An apparatus as claimed in claim 3, wherein said upper ends of said rods are fixed so that a clearance is provided between said upper ends of at least one pair of adjacent rods, and said lower ends of said rods are fixed so that a clearance is provided between said lower ends of at least one pair of adjacent rods.

7. An apparatus as claimed in claim 4, wherein said upper ends of said rods are fixed so that a clearance is provided between said upper ends of at least one pair of adjacent rods, and said lower ends of said rods are fixed so that a clearance is provided between said lower ends of at least one pair of adjacent rods.

8. An apparatus as claimed in claim 6, wherein said clearance between said lower ends of said adjacent rods is smaller than said clearance between said upper ends of said rods.

9. An apparatus as claimed in claim 7, wherein said clearance between said lower ends of said adjacent rods is smaller than said clearance between said upper ends of said rods.

10. An apparatus as claimed in claim 6, further comprising a water-cooled jacket of a heat-resistance material, said hollow hot cathode being enveloped by said jacket of a heat resistant material, a first opening in said jacket facing said workpiece being treated through which said electric are can pass to travel from said hollow hot cathode to said workpiece being treated.

11. An apparatus as claimed in claim 8, further comprising a jacket of a heat resistant material, said hollow hot cathode being mounted within said jacket, a first opening in said jacket facing said workpiece being treated through which said electric arc can pass to travel from said hollow hot cathode to said workpiece being treated.

12. An apparatus as claimed in claim 9, further comprising a jacket of a heat resistant material, said hollow hot cathode being mounted within said jacket, a first opening in said jacket facing said workpiece being treated through which said electric arc can pass to travel from said hollow hot cathode to said workpiece being treated.

13. An apparatus as claimed in claim 10, wherein said jacket is affixed on said cathode support.

14. An apparatus as claimed in claim 11, wherein said jacket is affixed on said cathode support.

15. An apparatus as claimed in claim 12, wherein said jacket is affixed on said cathode support.

16. An apparatus as claimed in claim 1, further comprising an electrically conducting conduit, said cathode support being mounted within said electrically conducting conduit, said electrically conducting conduit being electrically insulated from said electrically conducting cathode support and from said support means of said workpiece being treated.

17. An apparatus as claimed in claim 10, further comprising an electrically conducting conduit, said cathode support being mounted within said electrically conducting conduit, said electrically conducting conduit being electrically insulated from said cathode support and from said electrically conducting support means.

18. An apparatus as claimed in claim 17, wherein said jacket is affixed on said electrically conducting conduit.

19. An apparatus as claimed in claim 18, wherein said electrically conducting conduit and said jacket are made integral of a heat resistant electrically conducting material.

20. An apparatus as claimed in claim 13, wherein said jacket has a second opening through which a flow of gas can pass to said cathode inner space.

21. An apparatus as claimed in claim 19, wherein said jacket has at least one second opening through which a flow of gas can pass to said cathode inner space.

22. An apparatus as claimed in claim 18, further comprising means for delivering a flow of gas into said cathode inner space through at least one conduit between said cathode support and said electrically conducting conduit.

23. An apparatus as claimed in claim 21, wherein at least one conduit is provided between said electrically conducting conduit and said cathode support for delivering a flow of gas into said cathode inner space.

* * * * *